US005664952A

United States Patent [19]

Mockett et al.

[11] Patent Number: 5,664,952

[45] Date of Patent: Sep. 9, 1997

[54] MULTICHANNEL TRANSMISSION LINE CONNECTOR ASSEMBLY

[75] Inventors: Paul M. Mockett; David Forbush, both of Seattle, Wash.

[73] Assignee: University of Washington, Seattle, Wash.

[21] Appl. No.: 707,058

[22] Filed: Sep. 3, 1996

Related U.S. Application Data

[63] Continuation of Ser. No. 273,804, Jul. 12, 1994, abandoned.

[51] Int. Cl.[6] ..... H01R 13/658

[52] U.S. Cl. ..... 439/101; 439/610

[58] Field of Search ..... 439/101, 108, 439/497, 610, 98, 935, 607

[56] References Cited

U.S. PATENT DOCUMENTS

| | | | |
|---|---|---|---|
| 4,088,381 | 5/1978 | Harnett | 439/935 |
| 4,659,155 | 4/1987 | Walkup et al. | 439/108 |
| 4,773,878 | 9/1988 | Hansell, III | 439/610 |
| 4,932,888 | 6/1990 | Senor | 439/108 |
| 5,041,019 | 8/1991 | Sharp et al. | 439/935 |
| 5,114,364 | 5/1992 | Hunter | 439/497 |
| 5,194,020 | 3/1993 | Voltz | 439/579 |
| 5,456,618 | 10/1995 | Nakamura | 439/610 |

FOREIGN PATENT DOCUMENTS 0 616 390 A2 3/1994 European Pat. Off. .

*Primary Examiner*—Gary F. Paumen

*Attorney, Agent, or Firm*—Lee & Hayes, PLLC

[57] ABSTRACT

A multichannel transmission line connector assembly consists of a plug detachably connected to a receptacle. The plug has multiple sockets and the receptacle has multiple pins for electrical connection to associated sockets. The pin and socket coupling units are used to carry power, control, and data signals. The connector assembly also includes a conductive ground signal plate which is dedicated to carrying the ground signal. The plate extends along, and preferably encompasses, the pin and socket units. In this manner, the conductive ground signal plate serves a dual function of carrying the ground signal and operating as a protective sheath to prevent undesired signal interference. The connector assembly is well suited for transmission lines carrying high frequency signals.

10 Claims, 5 Drawing Sheets

MULTICHANNEL TRANSMISSION LINE CONNECTOR ASSEMBLY

RELATED APPLICATIONS

This application is a continuation of U.S. patent application Ser. 08/273,804, filed Jul. 12, 1994, now abandoned.

TECHNICAL FIELD

This invention relates to multichannel transmission line connectors.

BACKGROUND OF THE INVENTION

Multichannel transmission lines consist of a cable having many conductors for carrying electrical signals, such as power, control, data and ground signals. The conductors have extremely low impedance to quickly convey the signals through the transmission lines at high speeds.

The transmission line cables are terminated with a connector. Conventional connectors typically consist of a plug that detachably connects to a receptacle. The connector is fitted with pin and socket couplings where conductive pins are mounted to either the plug or receptacle and conductive sockets are mounted to the other. The pins are matingly received in corresponding sockets when the plug is connected to the receptacle. The individual pin and socket couplings are electrically coupled to the conductors in the cable to thereby convey respective power, control, data, and ground signal through the connector.

A drawback in conventional connectors is that the ground signal is carried on one of the pin and sockets couplings. The pin and socket coupling has a different impedance than the transmission line cable. This mismatched impedance causes reflection of the signal upon reaching the boundary between the conductor and coupling. The reflectance problem is aggravated as the signal pulse speed increases to high frequencies, such as gigahertz (GHz).

It is an object of this invention to provide a multichannel transmission line connector which reduces reflection and cross talk, particularly for high frequency signals.

BRIEF DESCRIPTION OF THE DRAWINGS

Preferred embodiments of the invention are described below with reference to the accompanying drawings, which are briefly described below. The same reference numerals are used throughout the disclosure to reference like components and features.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The figures illustrate a multichannel transmission line connector assembly 20 for coupling to an end of a multichannel transmission line (not shown). The multichannel transmission line has multiple low impedance conductors for carrying electrical power, control, data, and ground signals. The transmission line carries the signals over long or short distances, with such transmission lines being terminated by the connector assembly shown in the figures.

Connector assembly 20 has a plug 22 which is detachably connected to a connector terminal or receptacle 24. The preferred construction of plug 22 is described in more detail with reference to FIGS. 3–7. The preferred construction of receptacle 24 is described below with reference to FIGS. 8–10.

Figure 1:
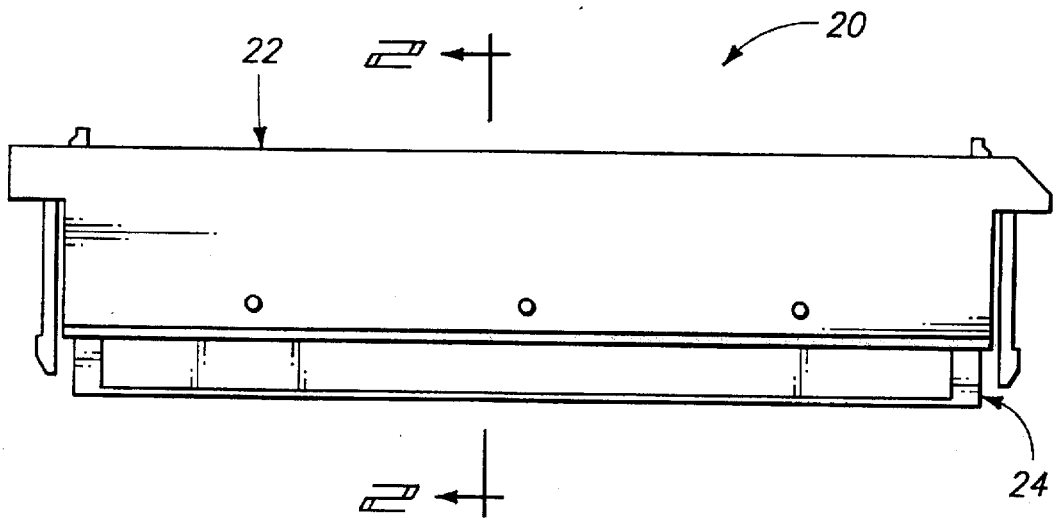
FIG. 1 is a longitudinal side view of a multichannel transmission line connector assembly according to this invention. The connector includes a plug portion and a receptacle portion.
Figure 2:
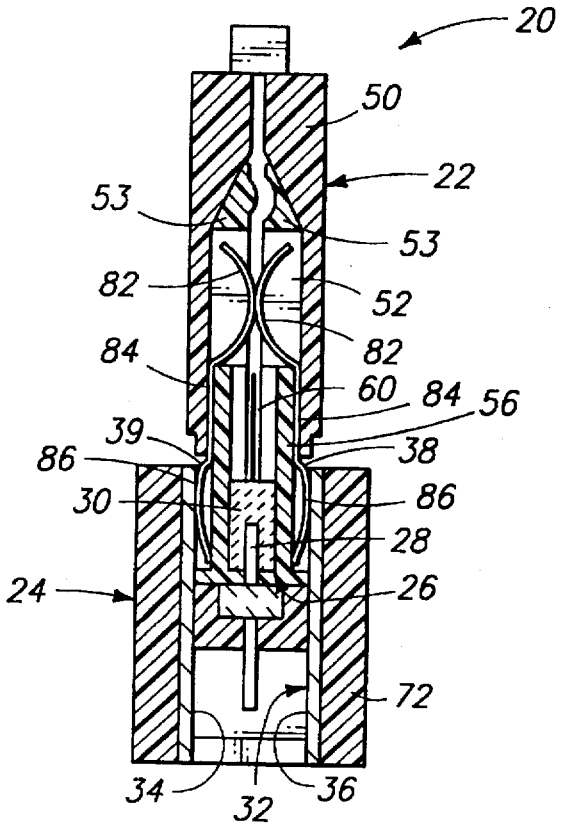
FIG. 2 is an enlarged cross-sectional view taken along line 2—2 in FIG. 1.

Connector assembly 20 also has a plurality of individual conductive coupling units 26 (FIG. 2) adapted for electrical connection to associated conductors within the transmission line. Coupling units 26 are preferably configured as first and second complementary coupling parts which can be detachable coupled to one another when plug 22 is connected to receptacle 24.

More preferably, the first and second complementary parts comprise pins 28 and sockets 30, where individual pins are matingly inserted into corresponding sockets when plug 22 is connected to a receptacle 24. The pin and socket coupling units 26 are electrically coupled to those conductors in the transmission lines that are dedicated to carrying power, control, and data signals. Coupling units 26 therefore convey the respective power, control, and data signals carried on the transmission line conductors through the conductor assembly 20. According to this invention, no pin and socket coupling units 26 are used for ground signals.

FIGS. 1–10 show a connector assembly having a single array of forty coupling units. FIG. 11 shows an alternative embodiment comprising twelve arrays of forty coupling units (i.e., 480 units). Other configurations and arrangements are possible within the scope of this invention. Although the preferred embodiment discloses pin and socket coupling units, it should be noted that other types of first and second complementary coupling parts which provide a detachable coupling unit for electrical mating connection be used within the context of this invention.

Figure 8:
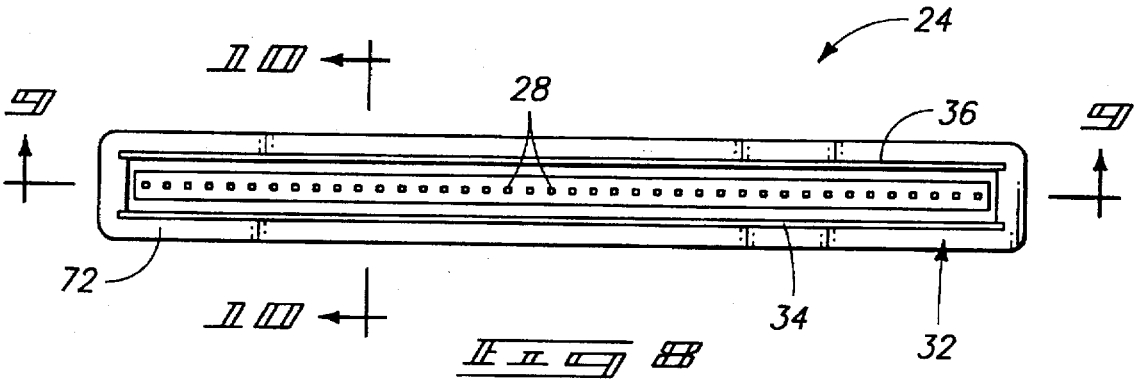
FIG. 8 is a longitudinal top view of the receptacle portion of the FIG. 1 connector assembly.

Connector assembly 20 also includes a continuous, conductive, reflectance-minimizing ground signal plate 32 (FIGS. 2, 8, and 10) which is electrically connected to one or more conductors within the transmission line that are dedicated to carrying the ground signal. The ground signal plate 32 preferably comprises two substantially planar walls 34 and 36 (FIGS. 2, 8, and 10) mounted to receptacle 24 and aligned on opposing sides of pin and socket coupling parts 26. The substantially planar walls extend longitudinally along and beyond the array of coupling units 26 (FIG. 8). In the alternative preferred embodiment illustrated in FIG. 11, a ground signal plate 40 entirely encompasses or surrounds the multiple coupling units 26.

Conductive interconnectors 38 and 39 are used to couple respective ground signal plates 36 and 34 to the one or more conductors within the transmission line used to carry the ground signals. These novel shaped interconnectors 38 and 39 have inherent spring bias which facilitate good electrical contact with both the signal carrying conductors in the transmission line and the ground signal plates 36 and 34. The interconnectors are impedance matched with the transmission line conductors and the ground signal plates 36 and 34. The interconnectors 38 and 39 are described below in more detail.

The multichannel transmission line connector assembly 20 of this invention is advantageous over prior art connectors in that the continuously planar ground signal plates 34, 36 and interconnectors 38, 39 provide a better terminal impedance match to the transmission line conductor. The impedance matched interface yields significantly less reflection in comparison to conventional connectors which carry the ground signal on the pins. The ground signal plate also serves as a protective sheath which prevents undesired extraneous signal interference and cross talk. The connector assembly 20 is particularly well suited for signals involving high frequency (e.g., GHz range where signal rise time is only a few nanoseconds) because the connector assembly substantially minimizes signal pulse reflection.

Figure 3:
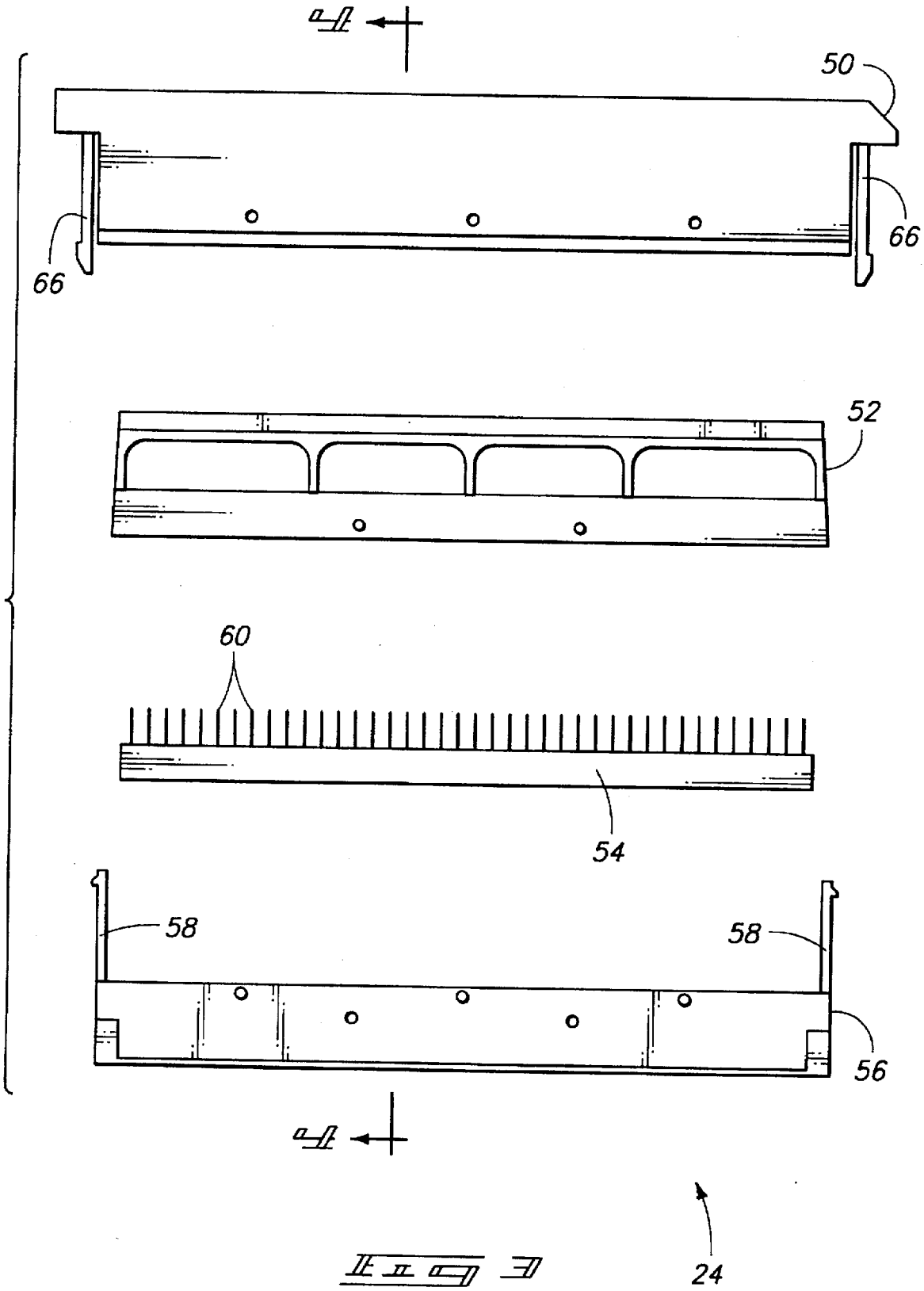
FIG. 3 is an exploded longitudinal side view of the component pieces which form the plug portion of the FIG. 1 connector assembly.
Figure 4:
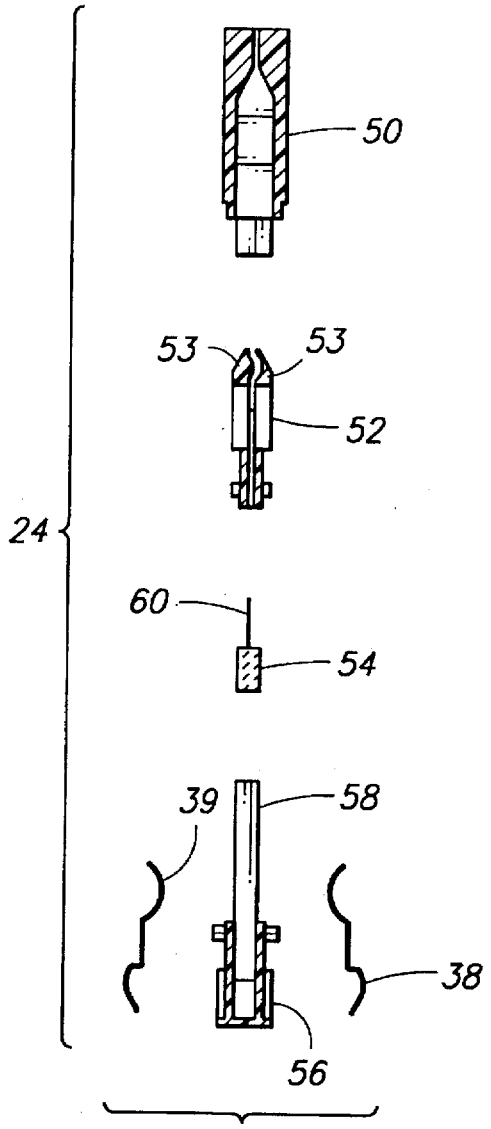
FIG. 4 is an exploded cross-sectional view taken along line 4—4 in FIG. 3.

A preferred construction of the multichannel transmission line connector assembly will now be described with reference to FIGS. 3–10. In FIGS. 3 and 4, plug 24 includes a shroud 50, a wedge or restrainer 52, a socket block 54, and a base 56. Base 56 includes deflectable interlocking arms 58 which couple to shroud 50 when the connector is assembled to hold wedge 52 and socket block 54 therebetween. Shroud 50 has two deflectable arms 66 which are used for mounting the connector assembly.

Socket block 54 has multiple prongs 60 which are electrically coupled via solder or other techniques to the conductors carried in the transmission line cable. Restrainer 52 has clamping members 53 (FIGS. 2, 4) which physically hold the cable conductors therein via a pinching action created through the opposing complimentary inclined surfaces on the exterior of restrainer 52 and the interior of shroud 50.

Figure 5:
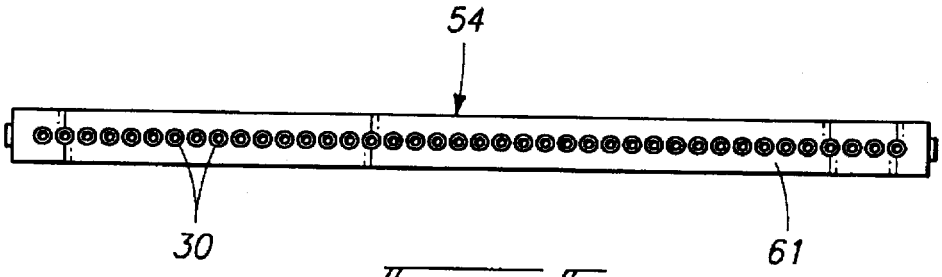
FIG. 5 is a bottom view of the FIG. 3 plug and illustrates plural connector sockets.
Figure 6:
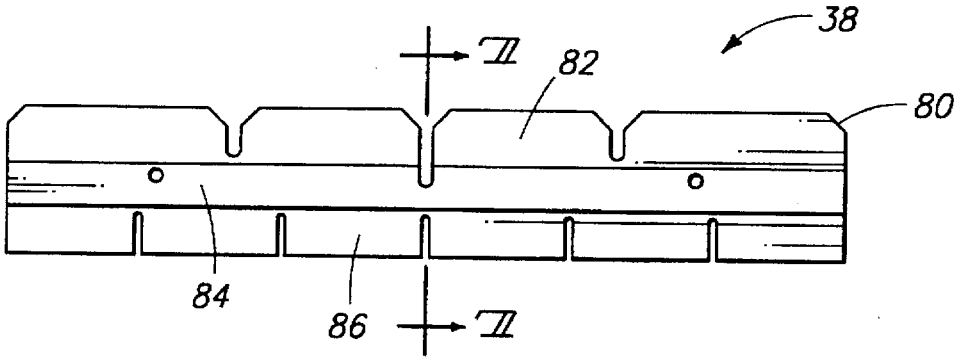
FIG. 6 is a longitudinal side view of a panel spring interconnector according to this invention.
Figure 7:
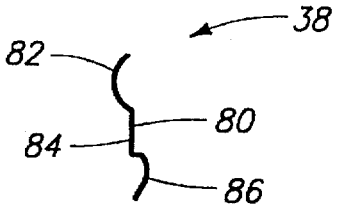
FIG. 7 is a cross-sectional view taken along line 7—7 in FIG. 6.

As shown in FIG. 5, socket block 54 has a housing 61 and a plurality of first complementary coupling parts in the form of orifices or sockets 30 formed therein. In the illustrated connector, socket block 54 has a linear array of forty sockets, although more or less sockets can be used and arranged as desired. Sockets 30 are axially aligned with associated prongs 60. The sockets are internally lined with a conductive material that is electrically connected to associated prongs 60.

It should be noted that the connector assembly of this invention is suitable for many different environments, including normal warm temperature environments and cryogenic environments. When used in cryogenic environments, the socket block housing 61 is preferably constructed of a selected insulating material, such as ceramic, so that the individual pin and socket coupling units are sealingly wrapped in an insulating material. Alternatively, for warm environments, socket block housing 61 may be injection molded from plastic.

Figure 10:
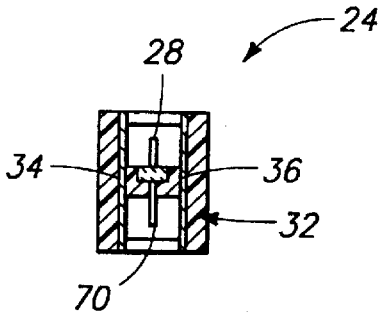
FIG. 10 is a cross-sectional view taken along line 10—10 in FIG. 8.
Figure 9:
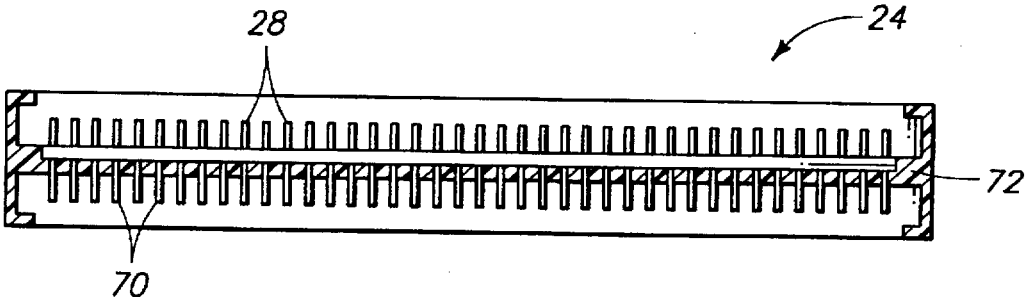
FIG. 9 is a cross-sectional view taken along line 9—9 in FIG. 8.
Figure 11:
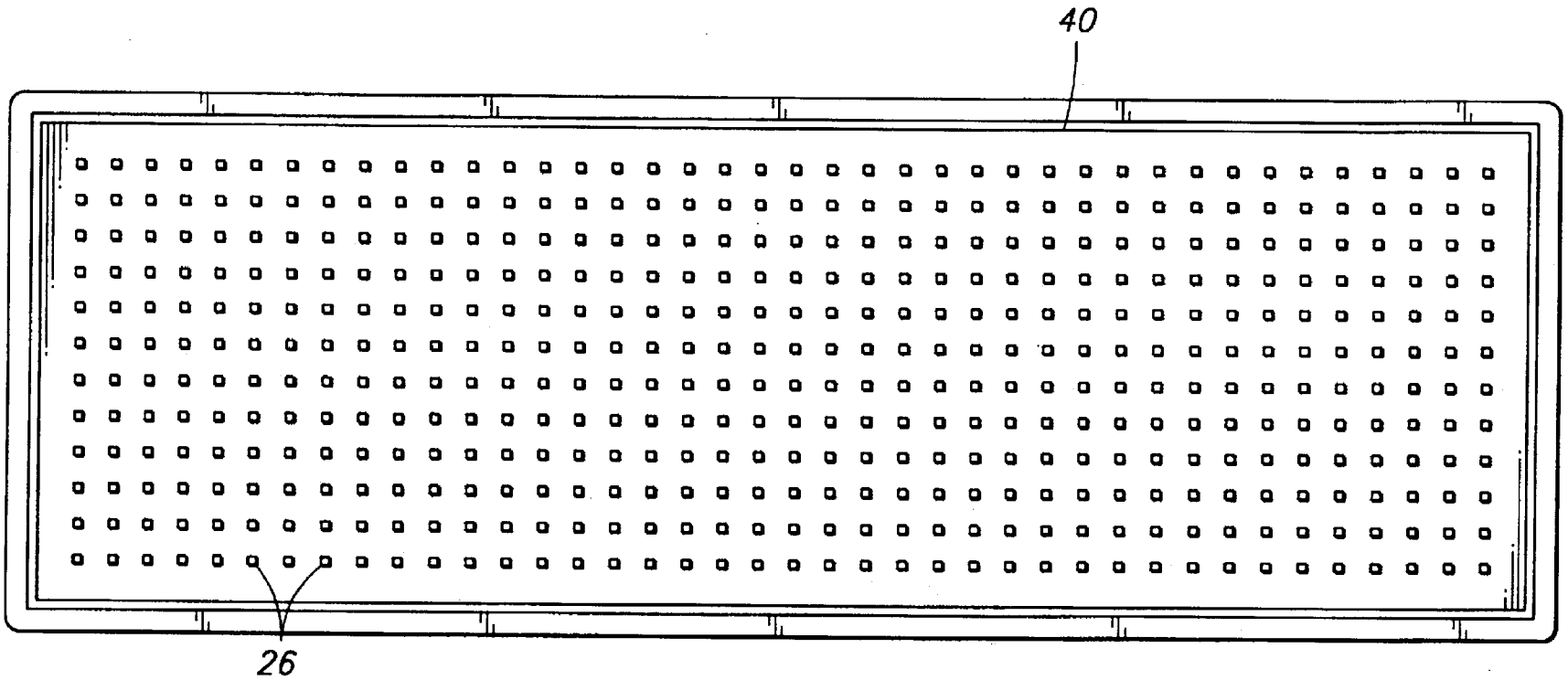
FIG. 11 is a longitudinal bottom view of a connector according to another embodiment of this invention.

With reference to FIGS. 8–10, receptacle 24 includes a plurality of second complementary coupling parts in the form of pins 28 supported in a receptacle housing 72. In this embodiment, receptacle 24 has a single linear array of forty conductive pins 28 which are spaced an appropriate distance to be matingly insertable into sockets 30 of plug 22. Pins 28 electrically contact the inner conductive lining within sockets 30 to form coupling units 26 conveying signals through the connector. Receptacle 24 also includes multiple pegs 70 which project in an opposite direction from associated pins 28. Pegs 70 represent the external signal terminating points of the connector assembly that can be further coupled to other devices or cable.

With reference to FIGS. 2, 4 and 6–7, ground signal interconnectors 38 and 39 are preferably formed as a longitudinally elongated panel spring member 80 which extends at least partially along ground signal plate 32. Panel spring member 80 has an upper section 82, a middle section 84, and a lower section 86. Upper section 82 contacts the one or more conductors within the transmission line used to carry the ground signal. Lower section 86 electrically contacts the ground signal plates 34 and 36 when the plug is connected to the receptacle.

In the most preferred construction, the upper and lower sections 82 and 86 comprise spaced, opposingly oriented, "semi-heart" shaped portions connected and separated by a linear middle section 84. The "semi-heart" shaped portions effectively form two terminal connecting spring portions that are opposingly sprung. This arrangement provides spring force in opposing directions about the middle section 84. The spring force facilitates good electrical contact between the panel member upper section 82 and the conductor, and between the panel memory lower section 86 and ground signal plate 32. The unique panel spring member enhances signal conveyance between the conductors in the transmission cable and the signal ground plate, while minimizing reflectance.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A multichannel transmission line connector assembly for coupling to a multichannel transmission line, the multichannel transmission line having multiple conductors for carrying electrical power, control, data and ground signals; the connector assembly comprising:

a plug; the plug having a single linear array of first complementary coupling parts adapted for direct connection to associated conductors within the transmission line used to carry the power, control and data signals;

a receptacle detachably connected to the plug; the receptacle having a single linear array of second complementary coupling parts for electrical connection to the associated first complementary coupling parts when the plug is connected to the receptacle, the linear arrays of the first and second coupling parts being arrayed in a first direction, individual pairs of mated first and second complementary coupling parts having outer ends which are oriented to extend in a second direction transverse to the first direction when the plug is connected to the receptacle;

the receptacle also having a conductive ground signal plate with opposing ends and opposing sides, the ground signal plate extending in the first direction along the linear arrays of the first and second coupling parts in a strip line configuration so that the opposing ends align approximately with or project beyond outer most ones of the second complementary coupling parts, the ground signal plate extending in the second direction so that the opposing sides align approximately with or project beyond the outer ends of the mated pairs of first and second coupling parts when the plug is connected to the receptacle; and a conductive interconnector adapted for electrically coupling the ground signal plate to one or more conductors within the transmission line used to carry the ground signal.

2. A multichannel transmission line connector assembly according to claim 1 wherein the first and second complementary coupling parts comprise pins and sockets; the pins being inserted into, and electrically contacting, the sockets when the plug is connected to the receptacle.

3. A multichannel transmission line connector assembly according to claim 1 wherein the first and second complementary coupling parts comprise individually sealed pin and socket units; the pins being inserted into, and electrically contacting, the sockets when the plug is connected to the receptacle; the individual pin and socket units being sealingly wrapped in a selected insulating material.

4. A multichannel transmission line connector assembly according to claim 1 wherein the insulating material is ceramic.

5. A multichannel transmission line connector assembly according to claim 1 wherein the ground signal plate comprises at least one substantially planar wall.

6. A multichannel transmission line connector assembly according to claim 1 wherein the ground signal plate comprises two substantially planar walls on opposing sides of the first and second coupling parts.

7. A multichannel transmission line connector assembly according to claim 1 wherein the ground signal plate is mounted to the receptacle.

8. A multichannel transmission line connector assembly according to claim 1 wherein the interconnector comprises a panel spring member extending at least partially along the ground signal plate.

9. A multichannel transmission line connector assembly according to claim 6 wherein the interconnector comprises a panel spring member extending at least partially along the ground signal plate, the panel spring member having first and second terminal connecting spring portions that are opposingly sprung; the first terminal connecting spring portion being adapted for contacting the one or more conductors within the transmission line used to carry the ground signal and the second terminal connecting spring portion contacting the ground signal plate when the plug is connected to the receptacle.

10. A multichannel transmission line connector assembly according to claim 1 wherein the interconnector comprises a panel spring member extending at least partially along the ground signal plate, the panel spring member having upper, middle, and lower sections; the upper section being adapted for contacting the one or more conductors within the transmission line used to carry the ground signal and the lower section contacting the ground signal plate when the plug is connected to the receptacle; the upper and lower sections comprising spaced, opposingly oriented, "semi-heart"-shaped portions connected by the middle section.

* * * * *